US005304035A

United States Patent [19]

Carter

[11] Patent Number: 5,304,035

[45] Date of Patent: Apr. 19, 1994

[54] PORTABLE NECKLACE FAN

[75] Inventor: C. Michael Carter, St. Louis, Mo.

[73] Assignee: Great Idea Products Company, St. Louis, Mo.

[21] Appl. No.: 964,744

[22] Filed: Oct. 22, 1992

[51] Int. Cl.[5] ..... F04D 29/64; F04D 29/00

[52] U.S. Cl. ..... 416/63; 416/146 R; 417/234; 362/108; 63/1.1; 63/2; 224/258; D11/2

[58] Field of Search ..... 416/5, 63, 146 R; 417/234; 362/108; 63/1.1, 2; 224/258; D11/2

[56] References Cited

U.S. PATENT DOCUMENTS

| | | | |
|---|---|---|---|
| 1,504,003 | 8/1924 | Trumbull | 416/5 |
| 2,572,889 | 10/1951 | Strykower | 224/258 |
| 2,710,338 | 6/1955 | Svalgaard | 362/108 |
| 3,168,748 | 2/1965 | Limberg | 416/63 |
| 3,225,982 | 12/1965 | Melton | 362/108 |
| 3,491,374 | 1/1970 | Frangos | 416/63 |
| 4,687,414 | 8/1987 | Wardy | 416/63 |

OTHER PUBLICATIONS

Jecar Enterprise Co., Ltd., brochure for Fun Fans (date unknown).

Jecar Enterprise Co., Ltd., packaging insert (date unknown).

*Primary Examiner*—Edward K. Look
*Assistant Examiner*—Michael S. Lee
*Attorney, Agent, or Firm*—Senniger, Powers, Leavitt & Roedel

[57] ABSTRACT

A portable fan worn in a self-oriented position on a wearer for directing a current of cooling air toward the wearer. The fan has a housing made of lightweight material, a lightweight electric motor in the housing powered by a source such as a battery so that the motor does not require physical connection to a fixed location remote from the wearer, a mechanism for moving air including a shaft connected to the motor, a hub on the shaft and a plurality of vanes projecting radially outwardly from the hub, the shaft, hub and vanes being made of a lightweight material, a shroud made of lightweight material connected to the housing and substantially enclosing said air moving mechanism, and a mechanism for supporting the fan below the wearer's face in an orientation wherein said air moving mechanism directs a current of air upwardly toward the wearer's face without being manually held.

10 Claims, 4 Drawing Sheets

PORTABLE NECKLACE FAN

SUMMARY OF THE INVENTION

This invention relates generally to fans and, more particularly, to a portable fan which can be worn.

Generally, fans used for personal cooling are designed for static use, i.e. the fan is placed in a desired location and plugged in an electrical outlet. However, a stationary fan, which must be plugged into an electrical outlet or mounted on a stationary support, cannot be readily used when outside, or if one is moving around away from the breeze generated by the fan. It would be desirable, such as when engaged in mobile outdoor activities in the summer (e.g., visiting recreational parks, going on picnics, etc.), to have the benefit of a fan's cooling breeze. Even when indoors, if moving around away from a stationary fan, the cooling effect of the fan is lost.

The utility of existing fans which are capable of mobile usage is limited because the fans must either be manually held or attached to the wearer through an additional article of clothing (e.g., a hat). Continuously holding and manually directing a portable fan while moving around is much too burdensome to make such a fan effective for remaining cool. Furthermore, the activities the user can engage in are limited because the fan must be held in one hand. Mobile fans which are attached to clothing requires the user to wear the additional clothing or forego the comfort of a fan. It is particularly undesirable to put on additional clothing, such as a hat, when indoors.

Among the several objects and features of the present invention may be noted the provision of a lightweight portable fan for mobile usage; the provision of such a portable fan which is self-orienting without the need to be manually held by the wearer; the provision of such portable fan which makes the choice of using such fan independent of the choice of what clothing the user will wear; and the provision of such a portable fan which is of relatively simple and inexpensive construction.

Generally, a portable fan of the present invention is adapted to be worn in a self-supported position on the wearer for directing a current of cooling air toward the wearer. The portable fan comprises a housing containing a lightweight electric motor. The electric motor is powered by a source, such as a battery, so that the motor does not require physical connection to a fixed location remote from the wearer. The electric motor rotates air moving means which comprises a shaft, a hub and a plurality of vanes. The shaft, hub and plurality of vanes are all made of a lightweight material such as plastic. A shroud made of lightweight material is connected to the housing and substantially encloses the air moving means. The portable fan further comprises means for supporting the fan below the wearer's face in an orientation wherein the air moving means directs a current of air upwardly toward the wearer's face without being manually held.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
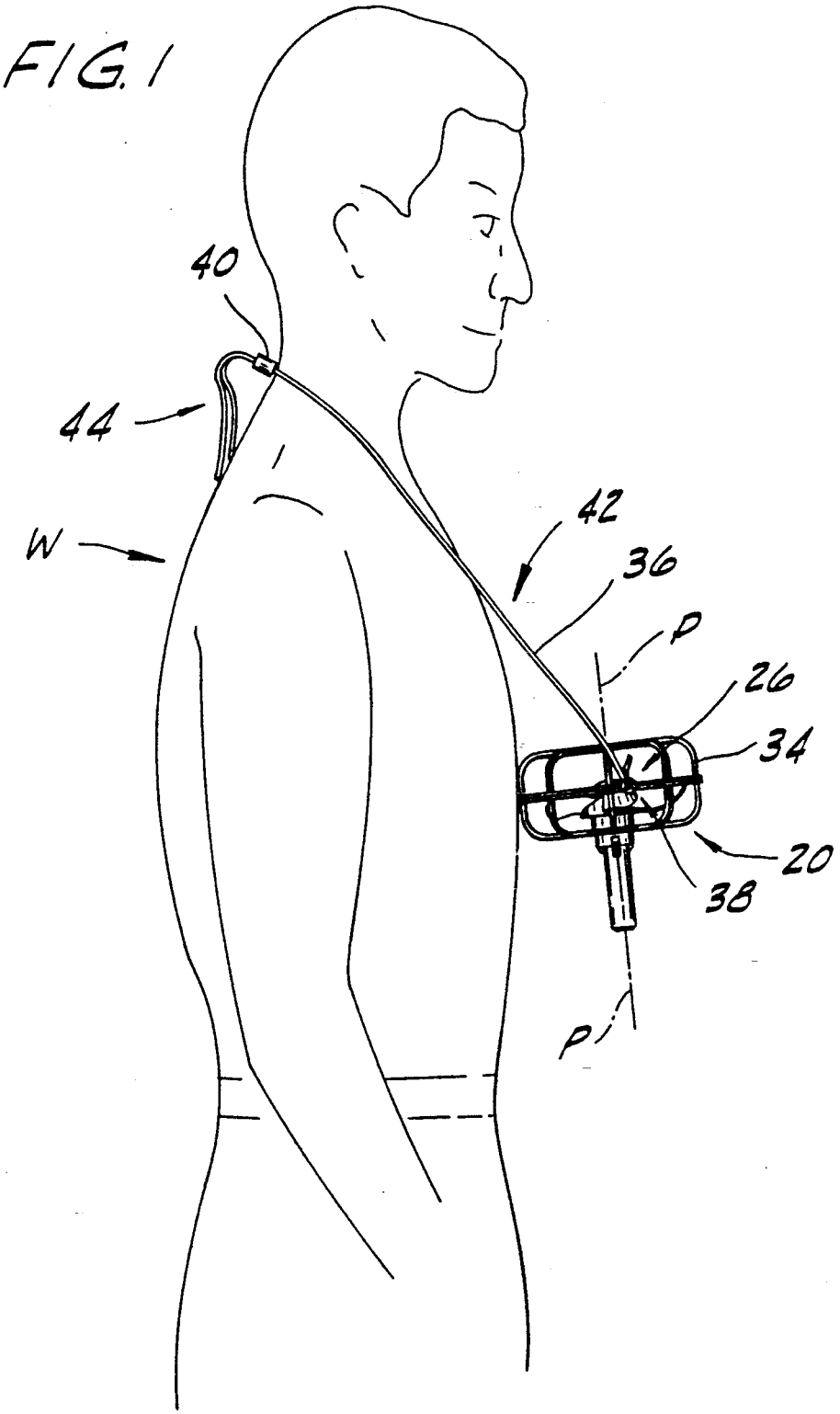
FIG. 1 is a side elevation of the portable fan in position on a wearer.

Referring now to the drawings, a portable fan for directing a current of air at the wearer (designated by reference numeral W) is indicated generally at 20. The portable fan 20 is adapted to be used during mobile activities to assist the wearer in remaining cool.

Figure 3:
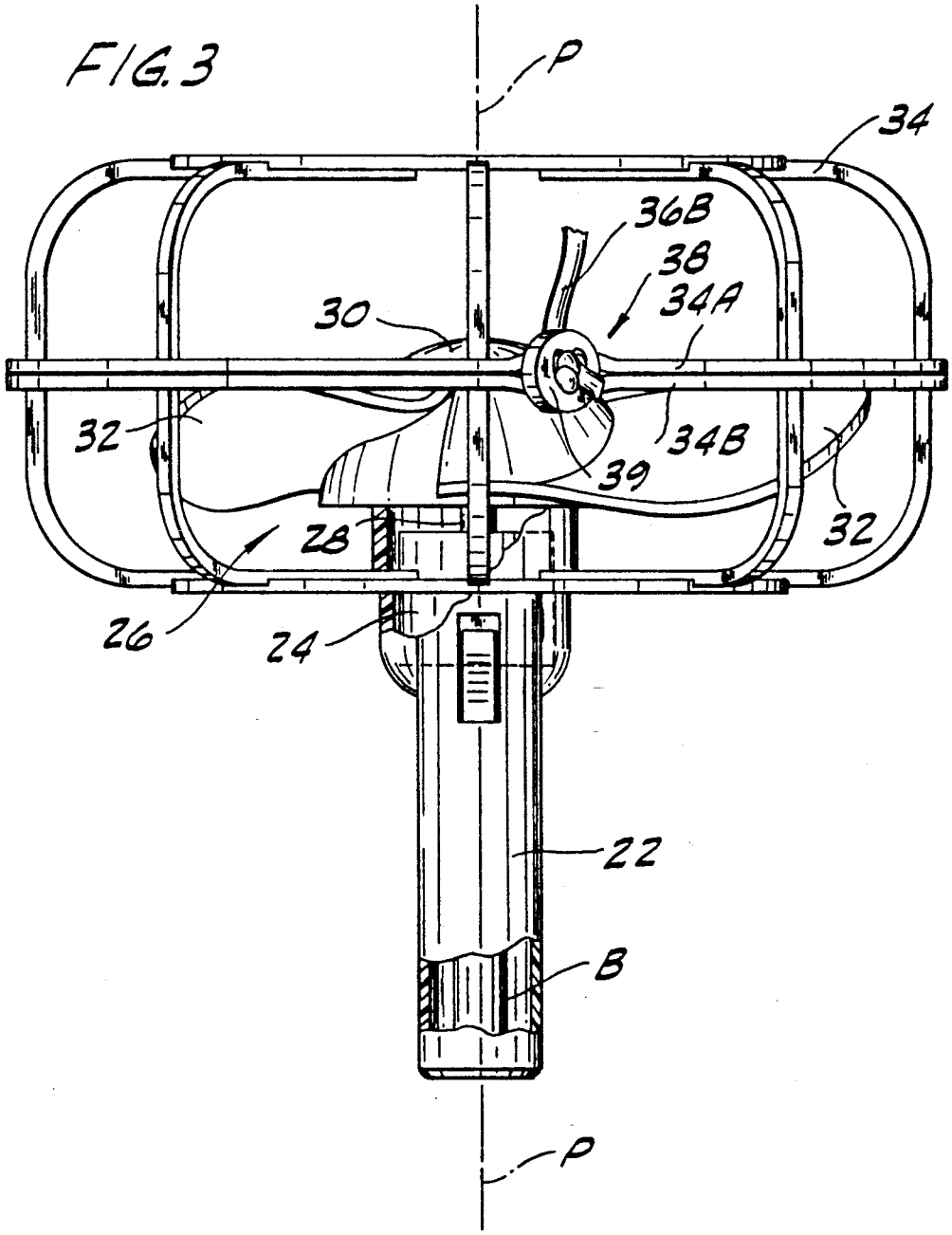
FIG. 3 is a side elevation of the portable fan.
Figure 4:
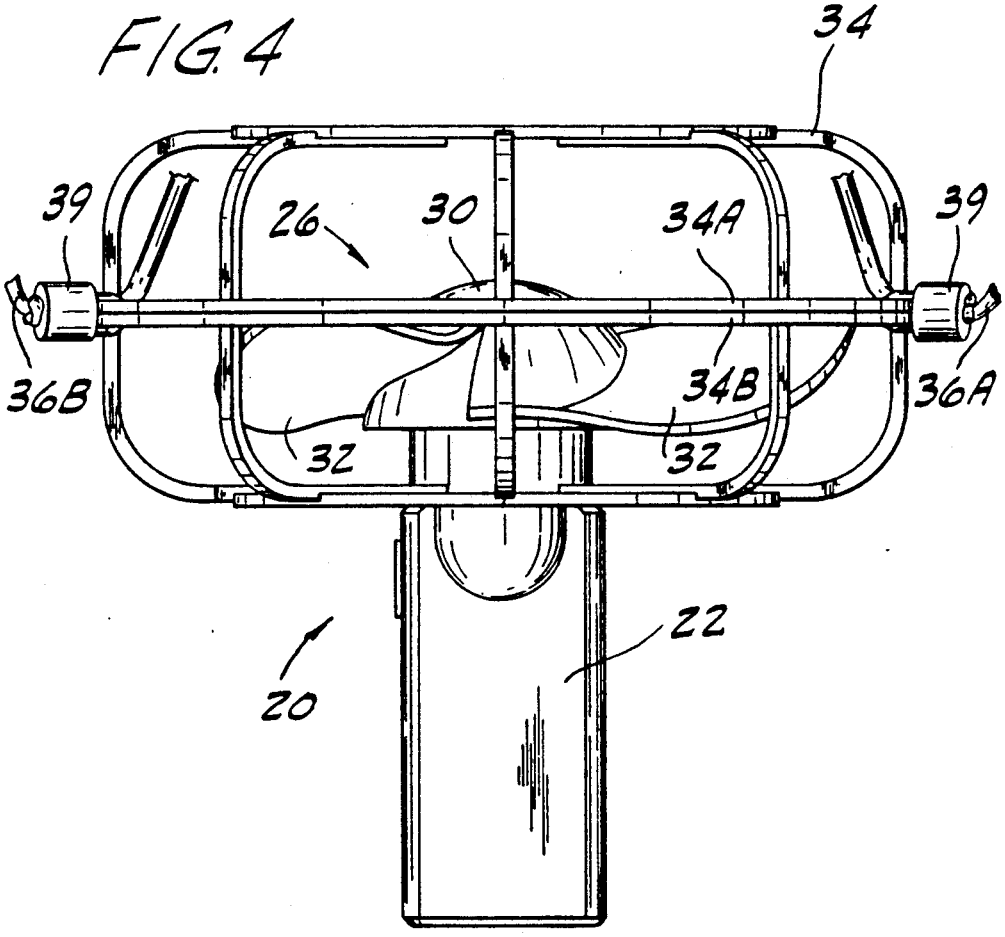
FIG. 4 is a top plan view of the portable fan.

The portable fan 20 comprises a housing 22 enclosing a lightweight electric motor 24. It will be understood that the electric motor 24 may be powered by a battery (e.g., battery B as shown in FIG. 3) or any other source which does not require a physical connection to a fixed location remote from the wearer. For instance, the applicant envisions the use of a solar energy power source, as one alternative. Means for moving the air, indicated generally at 26, comprises a shaft 28 connected to the motor 24, a hub 30 mounted on the shaft 28 and a plurality of vanes 32 projecting radially outwardly from the hub 30. The electric motor 24 rotates the shaft 28 which turns the hub 30 and vanes 32 creating a current of air. A shroud 34 is connected to the housing 22 and substantially encloses the air moving means 26. The shroud 34 is formed in two halves 34A, 34B which are connected at locations around the circumference of the shroud. The housing 22, shaft 28, hub 30, vanes 32 and shroud 34 are all made of a lightweight material such as plastic. It will be understood that any other lightweight material could be used without departing from the scope of the invention.

The portable fan 20 includes a cord 36 for supporting the fan below the wearer's face in an orientation wherein the air moving means 26 directs a current of air upwardly toward the wearer's face without being manually held. The cord 36 is attached to the fan 20 and forms a loop adapted to extend around the wearer's neck for supporting the fan (shown in FIG. 1). The ends of the cord 36A, 36B are attached to the shroud 34 by connection means, generally indicated at 38, at locations spaced laterally of the fan. In the illustrated embodiment, the connection means 38 comprises a space between the two halves 34A, 34B of the shroud through which the ends 36A, 36B of the cord are threaded, and tubular stops 39 which are received on respective ends of the cord to prevent them from withdrawing through the space between halves of the shroud. A knot is tied in each end (36A, 36B) of the cord to prevent the end from slipping out of its stop 39. It is to be understood that the connector means could have other forms without departing from the scope of the invention. For instance, the connector means could comprise a fixed post attached to the shroud to which the suspension means could be secured without the suspension means being threaded between the two halves of the shroud.

Means for adjusting the vertical separation between the fan 20 and the wearer's face comprises a sleeve 40 receiving two lengths of the cord 36 therethrough. The sleeve 40 divides the loop formed by the cord 36 into a first loop, generally indicated at 42, extending generally between the fan and the sleeve and a second loop, generally indicated at 44, located generally on the opposite side of the sleeve from the fan. The sleeve 40 has an internal dimension sized sufficiently small so that the sleeve grips the cord to prevent the two lengths of cord 36 from sliding through the sleeve 40 under the weight of the fan 20. However, the sleeve 40 permits the cords 36 to slide through the sleeve 40 when pulled with a force sufficiently greater than the weight of the fan 20. This allows the wearer to selectively adjust the size of the first loop 42 between the fan 20 and the sleeve 40. The sleeve 40 is adapted to be worn behind the wearer's neck so that adjusting the size of the first loop adjusts the distance between the fan and the wearer's face. The outer surface of the sleeve 40 is substantially smooth thereby making the sleeve 40 non-irritating when resting against the wearer's neck.

In operation, the first loop 42 is placed over the head and around the neck of the wearer with the sleeve 40 positioned behind the neck of the wearer and the fan 20 resting on the torso of the wearer. The ends 36A, 36B of the cord are connected by the connection means 38 to the shroud 34 at preferred locations outward of the body of the wearer from a plane (designated P in FIG. 1) passing through the center of mass of the fan, parallel to the axis of rotation of the shaft 28 and extending generally side-to-side of the wearer's body. As the shroud 34 rests against the wearer's torso, it is tilted generally toward the wearer as a result of the location of connection of the ends 36A, 36B. Thus, the current of air generated by the air moving means 26 is generally directed at the wearer's face, without being held or directed manually by the wearer. The wearer may walk around outside, away from fixed sources of power and still be cooled foregoing the use of one of his hands.

Figure 2:
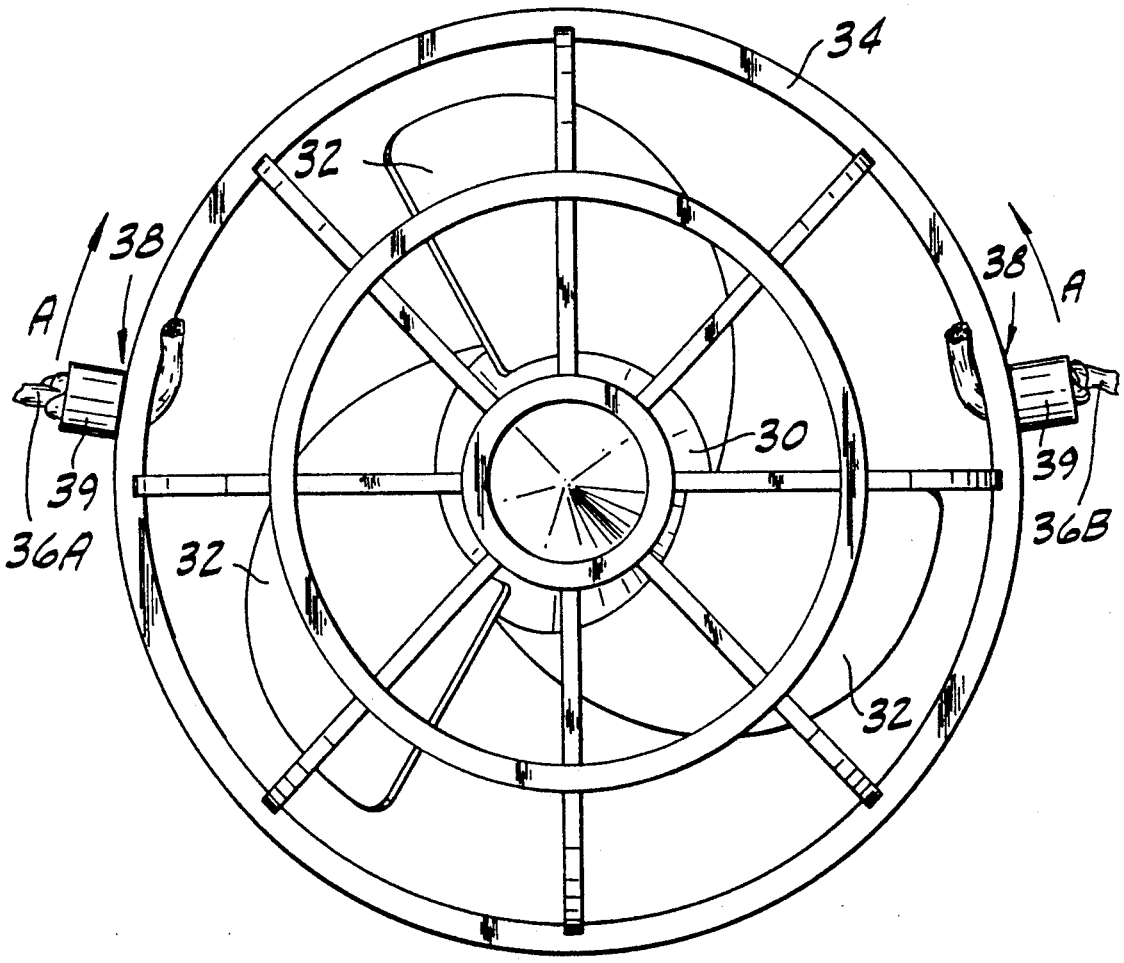
FIG. 2 is a front elevation of the portable fan.

The connection means 38 is constructed to permit the fan 20 to be tilted more toward or away from the wearer as desired. In that regard, the ends 36A, 36B of the cord 36 threaded between halves 34A, 34B of the shroud 34 and the stops 39 are slidable circumferentially of the shroud (in the directions indicated by arrow A in FIG. 2) between the locations where the shroud halves are connected together. As the ends 36A, 36B are slid outwardly from the wearer's body, the fan 20 is tilted more toward his body, and as the ends are moved inwardly to the wearer's body the fan is tilted more away from his body. The compressive force of the shroud halves 34A, 34B against the cord ends 36A, 36B is sufficient to hold the ends in any location in the possible range of motion of the ends. Thus, the wearer may select the desired orientation of the fan from a relatively large, continuous range of orientations without requiring the wearer to manually direct the fan. If the wearer wishes to direct the fan substantially away from his body, he may turn the entire fan over so that the cord ends 36A, 36B are located near his body.

The wearer may also selectively adjust the distance between the portable fan 20 and the wearer's face by sliding the sleeve 40 toward or away from the fan to adjust the size of the first loop 42. The smaller the first loop 42, the closer the fan is to the wearer's face and the larger the first loop, the farther it is away from the wearer's face. The sleeve 40 is worn behind the wearer's neck with the second loop 44 extending down generally onto the back of the wearer's clothing. After adjusting the fan 20 to the desired spacing from the wearer's face, and sliding the ends 36A, 36B of the cord to get the desired tilt of the fan 20, the portable fan's electric motor 24 is activated to direct a current of air at the wearer's face.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

I claim:

1. A portable fan adapted to be worn in a self-oriented position on the wearer for directing a current of cooling air toward the wearer, the fan comprising:

a housing made of lightweight material;

a lightweight electric motor in the housing powered by a source such as a battery so that the motor does not require physical connection to a fixed location remote from the wearer;

means for moving air comprising a shaft connected to the motor, a hub on the shaft and a plurality of vanes projecting radially outwardly from the hub, the shaft, hub and vanes being made of a lightweight material;

a shroud made of lightweight material connected to the housing a substantially enclosing said air moving means; and, a cord attached to one of the housing or the shroud of the fan and forming a loop adapted to extend around the wearer's neck for supporting the fan below the wearer's face against the wearer's torso in an orientation wherein the fan tilts towards the wearer's body and said moving means directs a current of air upwardly toward the wearer's face without being manually held, the fan being free of support structure separate and apart from the housing and shroud.

2. A portable fan as set forth in claim 1 further comprising means for adjusting the vertical separation between the fan and the wearer's face.

3. A portable fan as set forth in claim 2 wherein said adjusting means comprises a sleeve receiving two lengths of the cord therethrough and dividing the loop formed by the cord into a first loop extending generally between the fan and the sleeve and a second loop located generally on the opposite side of the sleeve from the fan, the sleeve having an internal dimension sized sufficiently small to hold the two lengths of cord from sliding through the sleeve under the weight of the fan, but permitting the cords to slide through the sleeve when pulled with a force sufficiently greater than the weight of the fan for adjusting the size of the first loop between the fan and the sleeve, the sleeve being adapted to be worn behind the wearer's neck so that adjusting the size of the first loop adjusts the distance between the fan and the wearer's face.

4. A portable fan as set forth in claim 1 wherein the cord is attached to the shroud of the fan at laterally outer locations, said locations being disposed outwardly from the body of the wearer and from a plane passing through the center of mass of the fan parallel to the axis of rotation of said air moving means and extending generally side-to-side of the wearer's body, whereby the fan is supported against the wearer's torso and tilted toward the wearer's body.

5. A portable fan as set forth in claim 4 further comprising means for movably connecting the cord to the fan for selectively shifting the locations at which the cord is attached to the fan, whereby a particular location of the connection of the cord to the fan corresponds to a certain degree of tilt of the fan relative to the wearer's torso.

6. A portable fan as set forth in claim 5 wherein the sleeve comprises a substantially smooth outer surface thereby making the sleeve non-irritating when resting against the wearer's neck.

7. A portable fan adapted to be worn in a self-oriented position on the wearer for directing a current of cooling air toward the wearer, the fan comprising:

a housing made of lightweight material;

a lightweight electric motor in the housing powered by a source such as a battery so that the motor does not require physical connection to a fixed location remote from the wearer;

means for moving air comprising a shaft connected to the motor, a hub on the shaft and a plurality of vanes projecting radially outwardly from the hub, the shaft, hub and vanes being made of a lightweight material;

a shroud made of lightweight material connected to the housing and substantially enclosing said air moving means;

a cord attached to one of the housing or the shroud of the fan and forming a loop adapted to extend around the wearer's neck for supporting the fan below the wearer's face against the wearer's torso in an orientation wherein the fan tilts towards the wearer's body and said moving means directs a current of air upwardly toward the wearer's face without being manually held, the cord being attached to one of the housing and the shroud of the fan at locations spaced laterally of the fan, said locations being disposed outwardly from the body of the wearer and from a plane passing through the center of mass of the fan parallel to the axis of rotation of said air moving means and extending generally side-to-side of the wearer's body, whereby the fan is supported against the wearer's torso and tilted toward the wearer's body, the fan being free of support structure separate and apart from the housing and shroud; and means for adjusting the vertical separation between the fan and the wearer's face.

8. A portable fan as set forth in claim 7 further comprising a sleeve receiving two lengths of the cord therethrough and dividing the loop formed by the cord into a first loop extending generally between the fan and the sleeve and a second loop located generally on the opposite side of the sleeve from the fan, the sleeve having an internal dimension sized sufficiently small to hold the two lengths of cord from sliding through the sleeve under the weight of the fan, but permitting the cords to slide through the sleeve when pulled with a force sufficiently greater than the weight of the fan for adjusting the size of the first loop between the fan and the sleeve, the sleeve being adapted to be worn behind the wearer's neck so that adjusting the size of the first loop adjusts the distance between the fan and the wearer's face.

9. A portable fan as set forth in claim 8 further comprising means for movably connecting the cord to the fan for selectively shifting the locations at which the cord is attached to the fan, whereby a particular location of the connection of the cord to the fan corresponds to a certain degree of tilt of the fan relative to the wearer's torso.

10. A portable fan as set forth in claim 8 wherein the sleeve comprises a substantially smooth outer surface thereby making the sleeve non-irritating when resting against the wearer's neck.

* * * * *